US006316746B1

(12) United States Patent
Golston

(10) Patent No.: US 6,316,746 B1
(45) Date of Patent: Nov. 13, 2001

(54) DEFROSTING ASSEMBLY FOR A MIRROR OF A VEHICLE

(76) Inventor: Carolyn M. Golston, 2601 Elm St., Denver, CO (US) 80207

( * ) Notice: Subject to any disclaimer, the term of this patent is extended or adjusted under 35 U.S.C. 154(b) by 0 days.

(21) Appl. No.: 09/602,239

(22) Filed: Jun. 23, 2000

(51) Int. Cl.[7] ..... H05B 1/00
(52) U.S. Cl. ..... 219/219; 219/476; 219/549
(58) Field of Search ..... 219/219, 203, 219/476, 478, 550, 528, 549, 505; 338/203, 295

(56) References Cited

U.S. PATENT DOCUMENTS

| | | | | |
|---|---|---|---|---|
| D. 354,266 | | 1/1995 | Mingledorff . | |
| 4,404,463 | | 9/1983 | Eder et al. . | |
| 4,488,033 | * | 12/1984 | Trachtenberg | 219/522 |
| 4,634,242 | | 1/1987 | Taguchi et al. . | |
| 4,864,316 | | 9/1989 | Kaoru et al. . | |
| 5,132,480 | | 7/1992 | Okada et al. . | |
| 5,352,870 | * | 10/1994 | Daugherty et al. | 219/549 |
| 5,448,397 | | 9/1995 | Tonar . | |
| 6,137,084 | * | 10/2000 | Thomas | 219/202 |

* cited by examiner

*Primary Examiner*—Teresa Walberg
*Assistant Examiner*—Vinod D. Patel

(57) ABSTRACT

A defrosting assembly for a mirror of a vehicle for keeping sideview mirrors free of ice. The defrosting assembly for a mirror of a vehicle includes a transparent planar sheet and an electrical wire. The electrical wire has a medial portion that is coupled to the transparent planar sheet. An adhesive is coupled to a face of the planar sheet. The adhesive may be coupled to the mirror of the vehicle thereby coupling the planer sheet and medial portion of the electrical wire to the mirror. The electrical wire is designed to couple to a battery of the vehicle thereby creating an electrical current through the electrical wire. The electrical current passing through the electrical wire heats the electrical wire. The heating of the electrical wire defrosts the mirror.

10 Claims, 2 Drawing Sheets

DEFROSTING ASSEMBLY FOR A MIRROR OF A VEHICLE

BACKGROUND OF THE INVENTION

1. Field of the Invention

The present invention relates to window defrosting devices and more particularly pertains to a new defrosting assembly for a mirror of a vehicle for keeping sideview mirrors free of ice.

2. Description of the Prior Art

The use of window defrosting devices is known in the prior art. More specifically, window defrosting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,404,463; U.S. Pat. No. 4,634,242; U.S. Pat. No. 5,132,840; U.S. Pat. No. 5,448,397; U.S. Pat. No. 4,864,316; and U.S. Pat. No. Des. 354,266.

While these devices fulfill their respective, particular objectives and requirements, the aforementioned patents do not disclose a new defrosting assembly for a mirror of a vehicle. The inventive device includes a transparent planar sheet and an electrical wire. The electrical wire has a medial portion that is coupled to the transparent planar sheet. An adhesive is coupled to a face of the planar sheet. The adhesive may be coupled to the mirror of the vehicle thereby coupling the planer sheet and medial portion of the electrical wire to the mirror. The electrical wire is designed to couple to a battery of the vehicle thereby creating an electrical current through the electrical wire. The electrical current passing through the electrical wire heats the electrical wire. The heating of the electrical wire defrosts the mirror.

In these respects, the defrosting assembly for a mirror of a vehicle according to the present invention substantially departs from the conventional concepts and designs of the prior art, and in so doing provides an apparatus primarily developed for the purpose of keeping sideview mirrors free of ice.

SUMMARY OF THE INVENTION

In view of the foregoing disadvantages inherent in the known types of window defrosting devices now present in the prior art, the present invention provides a new defrosting assembly for a mirror of a vehicle construction wherein the same can be utilized for keeping sideview mirrors free of ice.

The general purpose of the present invention, which will be described subsequently in greater detail, is to provide a new defrosting assembly for a mirror of a vehicle apparatus and method which has many of the advantages of the window defrosting devices mentioned heretofore and many novel features that result in a new defrosting assembly for a mirror of a vehicle which is not anticipated, rendered obvious, suggested, or even implied by any of the prior art window defrosting devices, either alone or in any combination thereof.

To attain this, the present invention generally comprises a transparent planar sheet and an electrical wire. The electrical wire has a medial portion that is coupled to the transparent planar sheet. An adhesive is coupled to a face of the planar sheet. The adhesive may be coupled to the mirror of the vehicle thereby coupling the planer sheet and medial portion of the electrical wire to the mirror. The electrical wire is designed to couple to a battery of the vehicle thereby creating an electrical current through the electrical wire. The electrical current passing through the electrical wire heats the electrical wire. The heating of the electrical wire defrosts the mirror.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new defrosting assembly for a mirror of a vehicle apparatus and method which has many of the advantages of the window defrosting devices mentioned heretofore and many novel features that result in a new defrosting assembly for a mirror of a vehicle which is not anticipated, rendered obvious, suggested, or even implied by any of the prior art window defrosting devices, either alone or in any combination thereof.

It is another object of the present invention to provide a new defrosting assembly for a mirror of a vehicle that may be easily and efficiently manufactured and marketed.

It is a further object of the present invention to provide a new defrosting assembly for a mirror of a vehicle that is of a durable and reliable construction.

An even further object of the present invention is to provide a new defrosting assembly for a mirror of a vehicle that is susceptible of a low cost of manufacture with regard to both materials and labor, and which accordingly is then susceptible of low prices of sale to the consuming public, thereby making such defrosting assembly for a mirror of a vehicle economically available to the buying public.

Still yet another object of the present invention is to provide a new defrosting assembly for a mirror of a vehicle which provides in the apparatuses and methods of the prior art some of the advantages thereof, while simultaneously overcoming some of the disadvantages normally associated therewith.

Still another object of the present invention is to provide a new defrosting assembly for a mirror of a vehicle for keeping sideview mirrors free of ice.

Yet another object of the present invention is to provide a new defrosting assembly for a mirror of a vehicle which includes a transparent planar sheet and an electrical wire. The electrical wire has a medial portion that is coupled to the transparent planar sheet. An adhesive is coupled to a face of the planar sheet. The adhesive may be coupled to the mirror of the vehicle thereby coupling the planer sheet and medial portion of the electrical wire to the mirror. The electrical wire is designed to couple to a battery of the vehicle thereby creating an electrical current through the electrical wire. The electrical current passing through the electrical wire heats the electrical wire. The heating of the electrical wire defrosts the mirror.

Still yet another object of the present invention is to provide a new defrosting assembly for a mirror of a vehicle that is adaptable for different size mirrors.

Even still another object of the present invention is to provide a new defrosting assembly for a mirror of a vehicle that allows the user to remove the ice from sideview mirrors without having to get out of the vehicle to scrap the ice off the mirror by hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
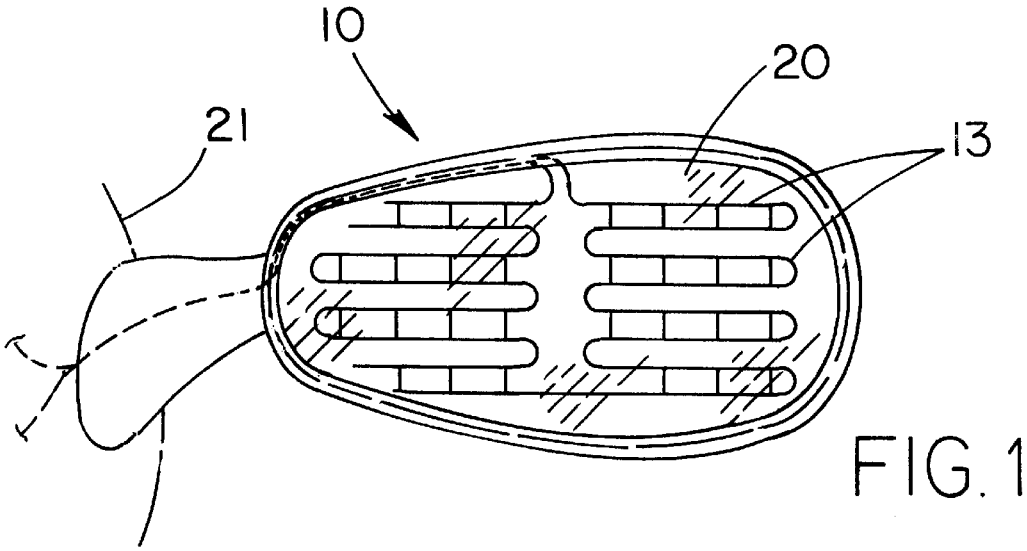
FIG. 1 is a schematic front view of a new defrosting assembly for a mirror of a vehicle according to the present invention coupled to a mirror.
Figure 2:
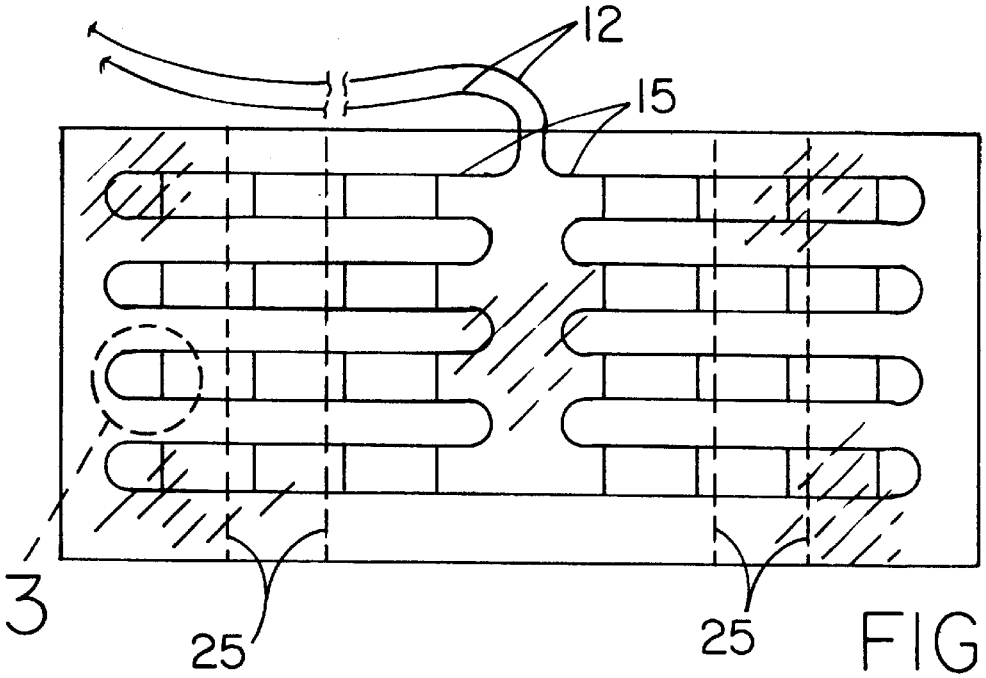
FIG. 2 is a schematic front view of the present invention.
Figure 3:
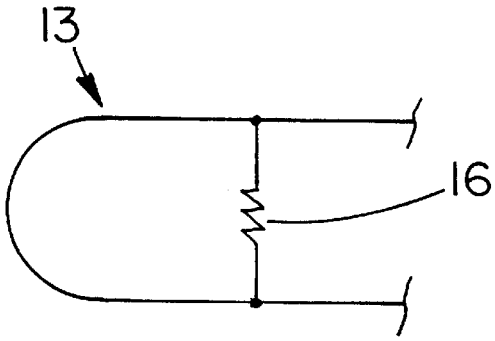
FIG. 3 is a schematic diagram of a heating element and resister of the present invention.
Figure 4:
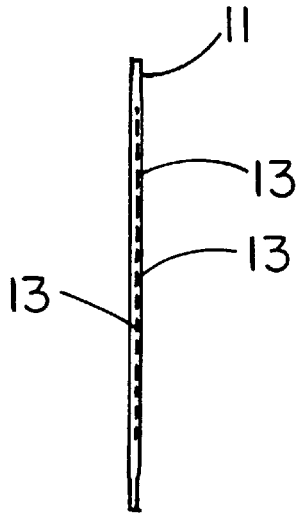
FIG. 4 is a schematic side view of the planer sheet of the present invention.
Figure 5:
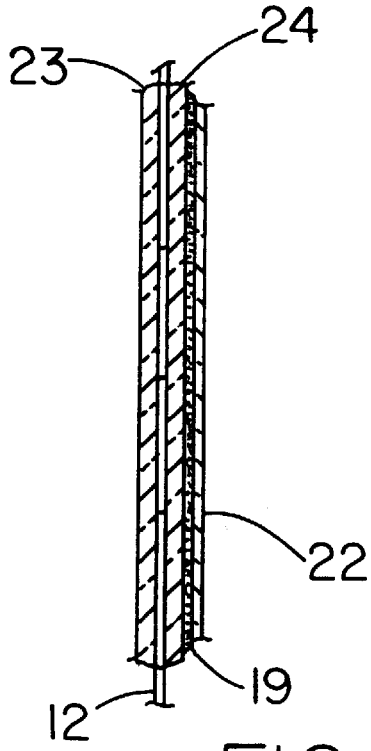
FIG. 5 is a schematic cross-sectional side view of the planer sheet of the present invention.
Figure 6:
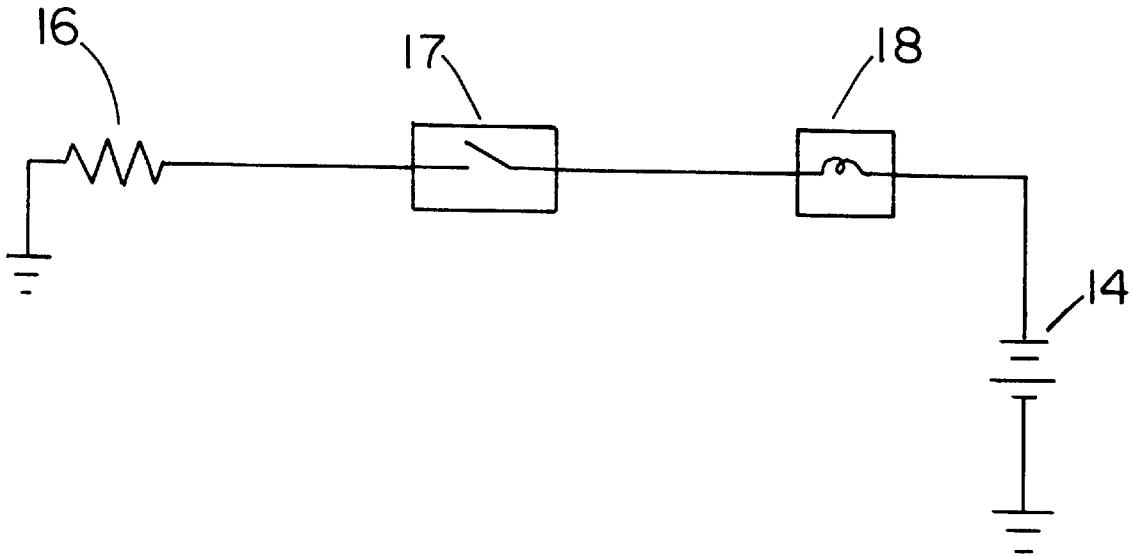
FIG. 6 is a schematic diagram of the electronic components of the present invention.

With reference now to the drawings, and in particular to FIGS. 1 through 6 thereof, a new defrosting assembly for a mirror of a vehicle embodying the principles and concepts of the present invention and generally designated by the reference numeral 10 will be described.

As best illustrated in FIGS. 1 through 6, the defrosting assembly for a mirror of a vehicle 10 generally comprises a transparent planar sheet 11, an electrical wire 12 and a plurality of heating elements 13.

The electrical wire 12 is electrically coupled to a battery 14 of the vehicle 21. The battery produces an electrical current through the electrical wire 12. The electrical current passing through the electrical wire 12 heats the electrical wire 12. Thus the electrical wire 12 defrosts the mirror 20 when the electrical current is passed through the electrical wire 12.

The electrical wire 12 has a medial portion 15 coupled to the transparent planar sheet 11. The medial portion 15 of the electrical wire 12 forms a grid that has a plurality of heating elements 13. A pair of parallel lengths of the electrical wire 12 form each heating element 13. Moreover, each of the heating elements 13 include a plurality of resistors 16. The resistors 16 extend between each pair of parallel lengths of electrical wire 12 that form the heating element 13.

A switch 17 is electrically coupled between the medial portion 15 of the electrical wire 12 and the battery 14 of the vehicle. The switch 17 has an on position wherein the switch 17 is closed. The on position allows electrical current to pass through the electrical wire 12. The switch 17 also has an off position wherein electrical current is prevented from passing through the electrical wire 12. The switch 17 is coupled to a dashboard of the vehicle 21. This permits manipulation of the switch 17 between the on position and the off position from an interior of the vehicle 21.

In addition, a fuse 18 is electrically coupled to the electrical wire 12. The fuse 18 prevents excess current from passing through the electrical wire 12 during use.

An adhesive 119 is coupled to a face of the planar sheet 11. The adhesive 19 is designed to couple the planer sheet 15 to the mirror 20 of the vehicle 21. A cove r member 22 is adhered to the adhesive 19 for preserving an adhesive quality of the adhesive 19 when not in use. The cover member 22 is removable from the adhesive 19 so the adhesive 19 may be exposed prior to coupling the planar sheet 11 to the mirror 20 of the vehicle 21.

The planar sheet 11 is made of a laminate plastic film that has a firs t portion 23 and a second portion 24. The medial portion 15 of the electrical wire 12 is embedded between the first and second portions 23, 24 of the laminate plastic film.

The planar sheet 11 may be trimmed to conform to the shape of the mirror 20 of the vehicle 21. The resistors 16 are selectively positioned in spaced relationship to each other along a length of the heating element 13. This spaced relationship allows a distal end of each heating element 13 to be trimmed without disrupting the flow of current through the rest of the heating element 13. Score lines 25 may be placed on the planer sheet 11 i to indicate where the planer sheet 17, should be trimmed.

In use, the planer sheet 11 is trimmed along the score lines 25 to conform to the shape of the mirror 20 of the vehicle 21 upon which the planer sheet 11 is to be coupled. The cover member 22 is removed from the adhesive 19 that is coupled to the face of the planer sheet 11. The planer sheet 11 is then coupled to the mirror 20 of the vehicle 21. The electrical wire 12 is then connected to the switch 17, the fuse 18 and the battery 14. Once the defroster assembly 10 is properly connected, the switch 17 may be placed in its on position thereby causing the mirror 20 to be defrosted.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A defroster assembly for a mirror of a vehicle, said defroster assembly comprising:

a transparent planar sheet;

an electrical wire having a medial portion coupled to said transparent planar sheet;

an adhesive coupled to a face of said planar sheet whereby said planar sheet is adapted for coupling to the mirror of the vehicle; and said electrical wire being adapted for coupling to a battery of the vehicle whereby said electrical wire is heated by electrical current passing through said electrical wire whereby said mirror is defrosted by said electrical wire when said electrical current is passed through said electrical wire;

said medial portion of said electrical wire forming a grid having a plurality heating elements, each heating element being formed by a pair of parallel lengths of said electrical wire, said heating elements being arranged into a pair of vertically aligned heating element sets; and each of said heating elements including at least one resistor, said resistor extending between said pair of parallel lengths of said electrical wire for maintaining electrical flow through said heating elements when a distal end of each of said heating elements is cut whereby said grid is adapted for conforming to a shape of the mirror by cutting said distal ends of selectable heating elements of said grid.

2. The defroster assembly of claim 1, further comprising:

each of said heating elements including a plurality of said resistors, each resistor extending between said pair of parallel lengths of said electrical wire.

3. The defroster assembly of claim 2, further comprising:

said planar sheet being shaped for conforming to the shape of the mirror by cutting away an outer portion of said planar sheet; and said resistors being positioned in spaced relationship to each other along a length of said heating element such that a resistor positioned adjacent to a cut end of said heating element permits flow of current through said electrical wire after said distal end of said heating element is trimmed whereby a length of each heating element is variable such that said grid is shaped to conform to the shape of the mirror while maintaining current flow through said heating elements.

4. The defroster assembly of claim 1, further comprising:

a switch electrically coupled between said medial portion of said electrical wire and the battery of the vehicle, said switch having an on position wherein said switch is closed whereby electrical current passes through said electrical wire and an off position wherein electrical current is prevented from passing through said electrical wire.

5. The defroster assembly of claim 4, further comprising:

said switch being adapted for coupling to a dashboard of the vehicle for permitting manipulation of said switch between said on position and said off position from an interior of the vehicle.

6. The defroster assembly of claim 4, further comprising:

a fuse electrically coupled to said electrical wire for preventing excess current from passing through said electrical wire during use.

7. The defroster assembly of claim 1, further comprising:

a cover member removably adhered to said adhesive for preserving an adhesive quality of said adhesive, said cover member being removable to expose said adhesive prior to coupling said planar sheet to the mirror of the vehicle.

8. The defroster assembly of claim 1, further comprising:

said planar sheet being a laminate plastic film having a first portion and a second portion, said medial portion of said electrical wire being embedded between said first and second portions of said laminate plastic film.

9. The defroster assembly of claim 1 further comprising:

said planar sheet being shaped for conforming to the shape of the mirror by cutting away an outer portion of said planar sheet.

10. A defroster assembly for a mirror of a vehicle, said defroster assembly comprising:

a transparent planar sheet;

an electrical wire having a medial portion coupled to said transparent planar sheet;

an adhesive coupled to a face of said planar sheet whereby said planar sheet is adapted for coupling to the mirror of the vehicle;

said electrical wire being adapted for coupling to a battery of the vehicle whereby said electrical wire is heated by electrical current passing through said electrical wire whereby said mirror is defrosted by said electrical wire when said electrical current is passed through said electrical wire;

said medial portion of said electrical wire forming a grid having a plurality heating elements, each heating element being formed by a pair of parallel lengths of said electrical wire, said heating elements being arranged into a pair of vertically aligned heating element sets;

each of said heating elements including at least one resistor, said resistor extending between said pair of parallel lengths of said electrical wire for maintaining electrical flow through said heating elements when a distal end of each of said heating elements is cut whereby said grid is adapted for conforming to a shape of the mirror by cutting said distal ends of selectable heating elements of said grid;

each of said heating elements including a plurality of said resistors, each resistor extending between said pair of parallel lengths of said electrical wire;

a switch electrically coupled between said medial portion of said electrical wire and the battery of the vehicle, said switch having an on position wherein said switch is closed whereby electrical current passes through said electrical wire and an off position wherein electrical current is prevented from passing through said electrical wire;

said switch being adapted for coupling to a dashboard of the vehicle for permitting manipulation of said switch between said on position and said off position from an interior of the vehicle;

a cover member removably adhered to said adhesive for preserving an adhesive quality of said adhesive, said cover member being removable to expose said adhesive prior to coupling said planar sheet to the mirror of the vehicle;

said planar sheet being a laminate plastic film having a first portion and a second portion, said medial portion of said electrical wire being embedded between said first and second portions of said laminate plastic film;

a fuse electrically coupled to said electrical wire for preventing excess current from passing through said electrical wire during use;

said planar sheet being shaped for conforming to the shape of the mirror by cutting away an outer portion of said planar sheet; and said resistors being positioned in spaced relationship to each other along a length of said heating element such that a resistor positioned adjacent to a cut end of said heating element permits flow of current through said electrical wire after said distal end of said heating element is trimmed whereby a length of each heating element is variable such that said grid is shaped to conform to the shape of the mirror while maintaining current flow through said heating elements.

* * * * *